US007769312B2

(12) United States Patent
Higashi

(10) Patent No.: US 7,769,312 B2
(45) Date of Patent: Aug. 3, 2010

(54) IMAGE FORMING APPARATUS INCLUDING OPERATIONAL COST EFFICIENCY MANAGEMENT UNIT

(75) Inventor: Shinya Higashi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 384 days.

(21) Appl. No.: 11/904,743

(22) Filed: Sep. 27, 2007

(65) Prior Publication Data

US 2008/0089709 A1 Apr. 17, 2008

(30) Foreign Application Priority Data

Oct. 17, 2006 (JP) ..... 2006-282764

(51) Int. Cl.
*G03G 21/02* (2006.01)

(52) U.S. Cl. ..... 399/79; 399/37; 399/75; 399/77

(58) Field of Classification Search ..... 399/37, 399/75, 77, 79, 82
See application file for complete search history.

(56) References Cited

U.S. PATENT DOCUMENTS

2003/0236601 A1* 12/2003 McLeod et al. ..... 701/29

FOREIGN PATENT DOCUMENTS

| | | |
|---|---|---|
| JP | 2000-112694 | 4/2000 |
| JP | 2005-014254 | 1/2005 |
| JP | 2005-254736 | 9/2005 |

OTHER PUBLICATIONS

Machine translation of JP-2005-254736.*

* cited by examiner

*Primary Examiner*—David M Gray
*Assistant Examiner*—G. M. Hyder
(74) *Attorney, Agent, or Firm*—Edwards Angell Palmer & Dodge LLP; David G. Conlin; David A. Tucker

(57) ABSTRACT

One embodiment of the present invention is provided with an image information storage unit, an image information processing unit, an actual image forming unit, an image information control unit that controls transfer of image information between each of the units, a power supply control unit, a cost information management unit that holds basic cost information prescribing power costs dependent on a usage time and calculates unit cost information, and an image processing time management unit that calculates a processing time required for image output jobs, wherein the image information control unit sets the execution timings of the image output jobs based on the basic cost information so that a total of image output costs of the image output jobs stored in the image information storage unit is lowest.

8 Claims, 4 Drawing Sheets

IMAGE FORMING APPARATUS INCLUDING OPERATIONAL COST EFFICIENCY MANAGEMENT UNIT

BACKGROUND Of THE INVENTION

This application claims priority under 35 U.S.C. §119(a) on Patent Application No. 2006-282764 filed in Japan on Oct. 17, 2006, the entire contents of which are hereby incorporated by reference.

1. Field of the Invention

The present invention relates to image forming apparatuses such as standalone machines including printing devices and facsimile machines, as well as multifunction machines and the like having various modes such as copying, printing, scanning, and faxing.

2. Description of the Related Art

Conventionally, various techniques have been proposed for curbing power costs due to the execution of print jobs in image forming apparatuses, including for example JP 2000-112694A (hereinafter referred to as patent document 1) and JP 2005-254736A (hereinafter referred to as patent document 2).

Patent document 1 discloses a print control device that uses printing resources secured intrinsically for use in a nighttime time period to perform printing output in a nighttime time period of print data that has been spooled in the daytime.

Furthermore, patent document 2 discloses an image forming apparatus described below in which image data received during a nighttime standby mode is successively stored to a hard disk, and when a printing completion time has been set for the stored image data, image forming operations are commenced during the nighttime mode period if the commencement time for the image forming operation is a time during the nighttime standby mode.

Both of the devices described in patent document 1 and patent document 2 are aimed at reducing power costs by executing accumulated print jobs during a nighttime mode period in which power rates are low.

However, from a perspective of power costs, there are times when carrying out printing output at nighttime does not necessarily result in a reduction in power costs. For example, in relation to print jobs received during the nighttime standby mode such as fax receptions or the like, a warm up operation is carried out each time fax data is received so that these can be output upon receipt thereof, which is a problem in that power costs rise undesirably.

Also, in order to keep the warm up operations to a minimum, in patent document 2, image data received during the nighttime standby mode is successively stored to a hard disk and the stored image data undergoes print processing as a group during the nighttime mode period, but in a case where there is a small amount of image data stored on the hard disk, the power costs may be substantially lower by performing printing after the completion of a warm up operation that is performed after turning on the power at daytime rather than performing print processing of the image data by commencing a warm up operation during the nighttime mode period.

SUMMARY OF THE INVENTION

The present invention has been devised focusing on this perspective, and it is an object thereof to provide an image forming apparatus that gives consideration to power consumption involved in warm up operations and is capable of setting print execution timings inclusive of both a nighttime mode and an ordinary daytime mode so that the image output costs (power costs) of image output jobs are lowest.

In order to address these issues, an image forming apparatus of the present invention is provided with an image information storage unit that stores inputted image information as original image information, an image information processing unit that performs a process of converting the image information stored in the image information storage unit to outputable image information, an actual image forming unit that forms on a physical medium the outputable image information that has undergone the process of conversion by the image information processing unit, an image information control unit that controls transfer of image information between each of the units, a power supply control unit that controls a state of power supply of each of the units as required, a cost information management unit that holds basic cost information prescribing power costs dependent on a usage time and calculates unit cost information of an arbitrary time, and an image processing time management unit that calculates a processing time required for image output jobs in which image forming is to be performed by the image information processing unit and the actual image forming unit based on the image information stored in the image information storage unit, wherein, in relation to execution timings of printing by the actual image forming unit, the image information control unit sets the execution timings of the image output jobs based on the basic cost information so that a total of image output costs of all target image output jobs stored in the image information storage unit is lowest.

In this configuration, in relation to execution timings of image output jobs by the actual image forming unit, the image information control unit calculates a total of image output costs of an arbitrary time for the image output jobs of all the image information based on a processing time of the image output jobs of all target image information stored in the image information storage unit calculated by the image processing time management unit and unit cost information calculated by the cost information management unit, and sets a time at which the total of the image output costs is lowest as the execution timings of the image output jobs.

That is, an image forming apparatus of the present invention calculates image output costs (that is, power costs) of image output jobs (that is, print jobs) of image information stored (saved) in the image information storage unit giving overall consideration to print execution timings not limited to the nighttime mode but including ordinary daytime mode as well in order to set print execution timings, and therefore the power costs incurred in print job processing can be kept lowest.

In this case, a configuration is possible wherein the image information control unit resets at a fixed interval the execution timings of the print jobs of all target image information stored in the image information storage unit when one or a plurality of sets of image information have been additionally stored in the image information storage unit before an execution timing of print jobs that has been set arrives. In this way, even when changes occur in conditions such as print jobs being added or time elapsing or the like, power costs can be kept lowest by resetting the execution timings of print jobs giving consideration to the changes in conditions.

Furthermore, a configuration is possible wherein the image information control unit resets the execution timings of the print jobs of all target image information stored in the image information storage unit each time new-image information is additionally stored in the image information storage unit before an execution timing of print jobs that has been set arrives. In this way, even when changes occur in conditions such as print jobs being added or time elapsing or the like, power costs can always be kept lowest by resetting the execution timings of print jobs each time giving consideration to the changes in conditions.

Furthermore, in the present invention, a configuration is possible wherein when new image information has been received during processing of print jobs in a nighttime rates time period in nighttime mode, the image information control unit executes a print job of the received image information subsequently after completion of the jobs currently being processed. By continuing printing in this manner, the number of times of warm up operations can be reduced and total power costs can be lowered.

Furthermore, in the present invention a configuration is possible wherein when new image information has been received during processing of print jobs in a nighttime rates time period in nighttime mode, the image information control unit executes a print job of the received image information after nighttime mode is canceled and a daytime warm up is performed. By performing execution after the canceling of nighttime mode in this manner, the number of times of warm ups can be reduced and total power costs can be lowered.

Furthermore, in the present invention a configuration is possible wherein when there is a large quantity of print jobs of image information stored in the image information storage unit, the image information control unit divides the print jobs into image processing jobs, in which image information stored in the image information storage unit undergoes a conversion process by the image information processing unit into outputable image information, and image forming jobs, in which the outputable image information is formed onto a physical medium by the actual image forming unit, then calculates power costs required for the image processing jobs and the image forming jobs respectively and sets execution timings of the jobs respectively so that a total cost incurred in processing is lowest. For example, the image processing jobs are executed during the nighttime mode period and the image forming jobs are executed after nighttime mode is canceled and a daytime warm up is performed. This enables warm up operations during the nighttime mode period to be omitted, and therefore power costs can be reduced by a proportional amount.

Furthermore, in the present invention the image information control unit can be configured such that when there is a large quantity of print jobs of a plurality of sets of image information stored in the image information storage unit during a nighttime mode period, printing is executed within a remaining time of the nighttime mode, and when there is a small quantity of the print jobs, printing is executed in a daytime time period. This reduces the number of times of warm ups and enables total power costs to be lowered.

Furthermore, when the image forming apparatus of the present invention is an apparatus having a facsimile reception function, the image information control unit transitions to nighttime mode after having continuously executed print jobs of image information remaining in the image information storage unit when a timing for transitioning to the nighttime mode arrives during execution of the print jobs of image information stored in the image information storage unit. This reduces the number of times of warm ups and enables total power costs to be kept lower.

Furthermore, when the image forming apparatus of the present invention is a printer apparatus, the image information control unit shuts off power after having continuously executed print jobs of image information remaining in the image information storage unit when a timing for transitioning to nighttime mode arrives during execution of the print jobs of image information stored in the image information storage unit. By doing this, power costs can be kept even lower compared to transitioning to nighttime mode.

DESCRIPTION OF THE PREFERRED EMBODIMENTS

Figure 1:
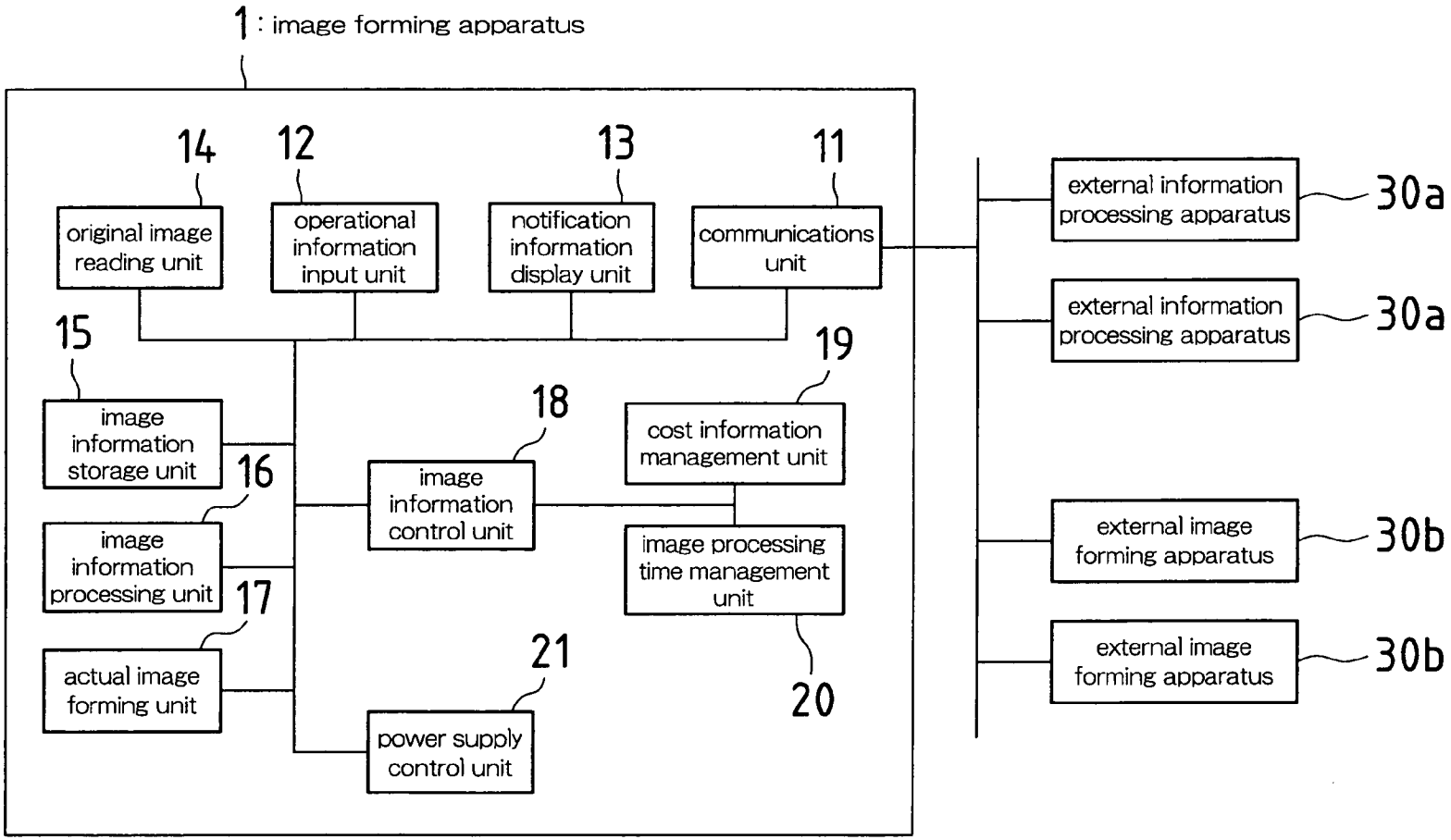
FIG. 1 is a functional block diagram showing one embodiment of an image forming apparatus according to the present invention.

Hereinafter, embodiments of the present invention are described with reference to the accompanying drawings. FIG. 1 is a functional block diagram showing one embodiment of an image forming apparatus according to the present invention.

<Overall Description of Image Forming Apparatus>

Broadly divided, an image forming apparatus 1 according to the present invention is constituted by a communications unit 11, an operational information input unit 12, a notification information display unit 13, an original image reading unit 14, an image information storage unit 15, an image information processing unit 16, an actual image forming unit 17, an image information control unit 18, a cost information management unit 19, an image processing time management unit 20, and a power supply control unit 21.

The communications unit 11 is a means for carrying out communication of various information between the image forming apparatus 1 and external apparatuses, and print jobs are received through the communications unit 11 from external information processing apparatuses 30*a* such as a PC or the like and external image forming apparatuses 30*b* such as a facsimile machine or the like.

The operational information input unit 12 is an operation panel or the like that performs direct operational input to the image forming apparatus 1.

The notification information display unit 13 is an LCD panel or an LED or the like for conveying information directly to an operator from the image forming apparatus 1.

The original image reading unit 14 reads an image of an original that has been placed on an original placement platform.

The image information storage unit 15 is a storage device for storing inputted image information such as photocopied originals inputted from the original image reading unit 14 and print data received from the external information processing apparatuses 30*a* via the communications unit 11. The image information storage unit 15 may be a volatile DRAM or the like and may be a nonvolatile flash memory or a hard disk or the like.

The image information processing unit 16 converts inputted image information or stored image information into a form capable of being inputted to the actual image forming unit 17 and is a means for carrying out image processing on photocopied image data and rasterizing print data.

The actual image forming unit 17 is a means for actually performing image forming on a physical medium such as a recording paper, and includes an engine portion of a copier or a printer.

The image information control unit 18 is a means for controlling the transfer of image information based on information of the cost information management unit 19 and the image processing time management unit 20, which are described later.

The power supply control unit 21 supplies power to the units during operation at the various stages from the input of image information to image information storage, image information processing, and actual image forming, and is provided with a function aimed at achieving power savings by shutting off power supply to other units that are not operating. With this function it is possible to calculate for each unit the power consumed by each unit in executing a certain image output job, thus enabling management of power consumption on a per-job basis.

The cost information management unit 19 holds information relating to power consumed by the image forming apparatus 1 and relating to various cost systems, and calculates unit power costs of specified times in accordance with this information.

The image processing time management unit 20 calculates a time required to form an image for an inputted print job until completion of print output.

In the above-described configuration, in relation to print execution timings by the actual image forming unit 17, the image information control unit 18 sets the execution timings of print jobs based on basic cost information held in the cost information management unit 19 so that the total power cost of the print jobs of all the image information stored (hereinafter "saved") in the image information storage unit 15 is lowest. Hereinafter, specific description is given concerning a process for setting the execution timings of print jobs.

<Fundamental Description of Power Costs>

Figure 2:
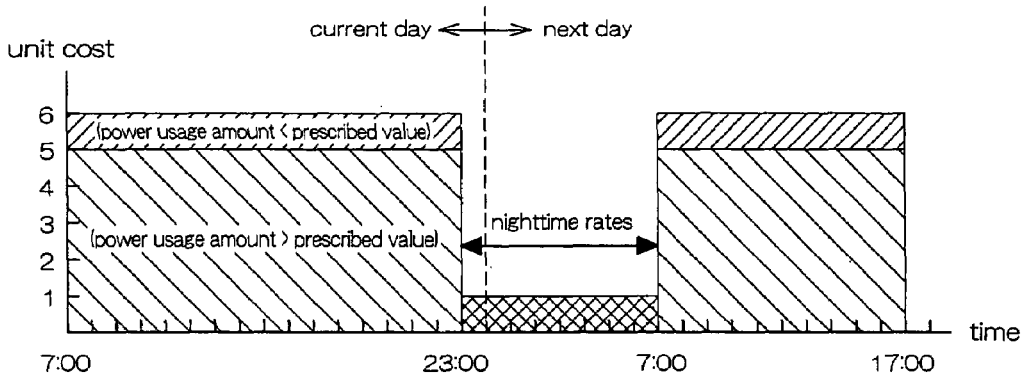
FIG. 2 is an explanatory diagram that schematically illustrates power costs.

FIG. 2 is an explanatory diagram that schematically illustrates power costs.

Generally, the unit costs of nighttime power rates are set lower compared to those of the daytime. In the example shown in FIG. 2, from 11 P.M. at night to 7 A.M. the following morning is a time period in which the unit cost is set lower. Furthermore, there is also a contractual system in which the unit cost of daytime power rates becomes cheaper when a power usage amount exceeds a prescribed value. In the example of FIG. 2, the unit cost is 6 when the power usage amount is a prescribed value or lower, but the unit cost is calculated as 5 when the power usage amount exceeds the prescribed value.

<Calculation Example of Power Costs When Processed in Time Period of Nighttime Rates>

Figure 3:
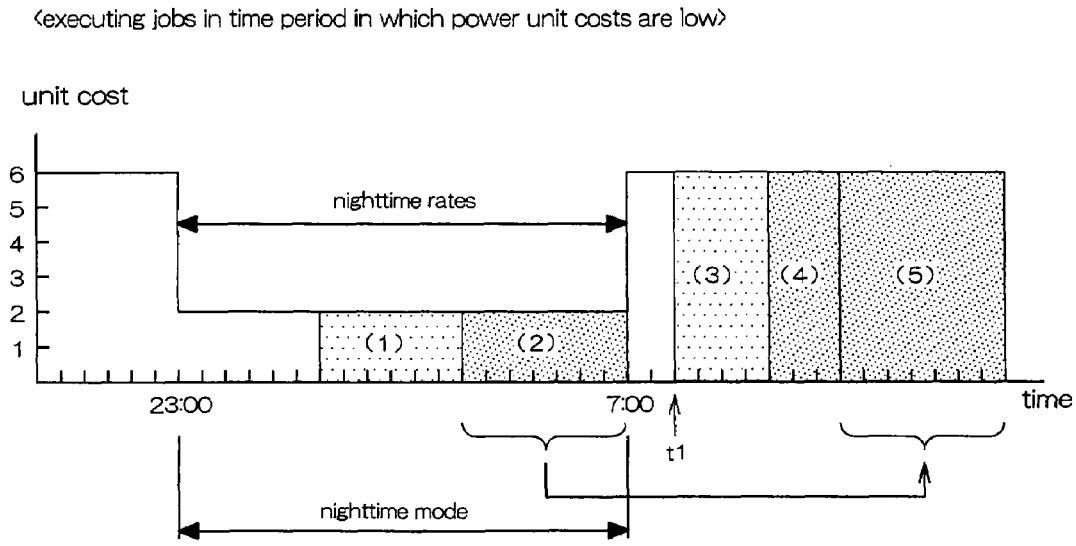
FIG. 3 is an explanatory diagram showing a calculation example of power costs when print jobs that have been saved during a nighttime mode are processed in a time period in which electricity rates are lower (here, this is the time period of nighttime rates).

FIG. 3 shows power costs when print jobs of image information saved in the image information storage unit 15 during a nighttime mode are processed in a time period in which the electricity rates are lower (here, this is the time period of nighttime rates). The nighttime mode referred to here is a so-called sleep mode, which is one of the power saving modes of image forming apparatuses such as MFPs (multifunction printers), and is aimed at reducing power consumption by shutting off the power except for a necessary minimum of functions. In general, various events trigger a transition to this nighttime mode, including operation by a user, passage of a fixed time in which jobs do not occur, and the arrival of a specified time. Similarly, various events in general trigger a cancellation of the nighttime mode, including execution of a job such as receiving a fax, and the arrival of a specified time. That is, the image forming apparatus 1 of the present embodiment is configured such that in the time period of nighttime rates a transition is made to nighttime mode, which is a power saving mode, and after a job is executed such as receiving a fax while still in nighttime mode, a transition is made again to nighttime mode until the time period of nighttime rates elapses.

In the example shown in FIG. 3, the image information control unit 18 calculates the time required for the print jobs of the image information saved in the image information storage unit 15 to be processed and commences execution of the print jobs with a timing in which the processing of all the print jobs finishes at the completion time of nighttime rates (7 A.M. next morning). First, a warm up (1) is carried out for putting the image forming apparatus 1, which has transitioned to nighttime mode, into a state capable of printing. Next, the print jobs (2) of the image information saved in the image information storage unit 15 are actually executed. After this, when certain conditions are satisfied, the image forming apparatus 1 returns (time t1) from nighttime mode. At this time, a warm up (3) is performed again. After this, when there is a job (4) of some kind, the job is executed.

When print jobs are processed during the time of nighttime rates in this manner, the costs incurred in the warm up (1) in the example shown in FIG. 3 are 12 (=6 units of time×2 units of cost) and the costs incurred in processing the print jobs (2) are 14 (=7 units of time×2 units of cost), which comes to a total of 26. When this is carried out in print processing (5) after the canceling of nighttime mode, the costs incurred in printing are 42 (=7 units of time×6 units of cost). That is, there are zero costs incurred in warming up at the time of executing the print processing (5) since a warm up is performed at the time of canceling the nighttime mode. Accordingly, when print processing is performed during nighttime mode, the cost is 14 and when print processing is performed after the canceling of nighttime mode, the cost is 42, and therefore in this case costs can be kept lower by performing print processing in nighttime mode.

Figure 4:
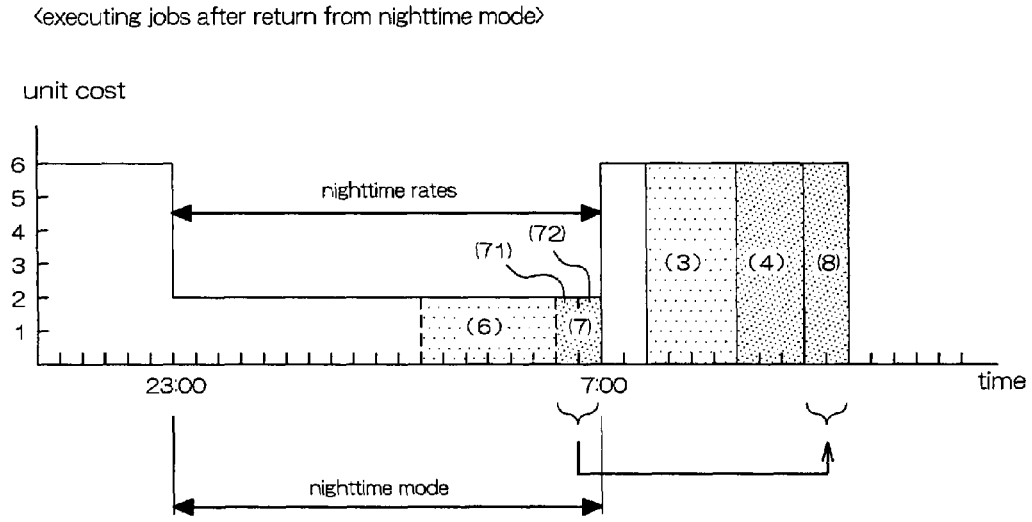
FIG. 4 is an explanatory diagram showing a calculation example of power costs when there is a small quantity of print jobs saved during nighttime.

On the other hand, FIG. 4 shows power costs when there is a small quantity of print jobs of image information saved during nighttime. That is, the power costs required by the warm up (6) are larger compared to the power costs of executing the print jobs (7), such that greater costs are incurred undesirably. In a case such as this, the number of times of warming up can be reduced by processing the print jobs after the canceling of nighttime mode, and therefore it is possible to keep costs low. In the case shown in FIG. 4, when print jobs (7) are processed during the time of nighttime rates, the costs incurred in the warm up (6) are 12 (=6 units of time×2 units of cost) and the costs incurred in processing the print jobs (7) are 4 (=2 units of time×2 units of cost), which comes to a total of 16. When this is carried out in print processing (8) after the canceling of nighttime mode, the costs incurred in printing are 12 (=2 units of time×6 units of cost). In this way, when print processing is performed during nighttime mode, the cost is 16 and when print processing is performed after the canceling of nighttime mode, the cost is 12, and therefore in this case costs can be kept lower by performing print processing after the canceling of nighttime mode.

Figure 5:
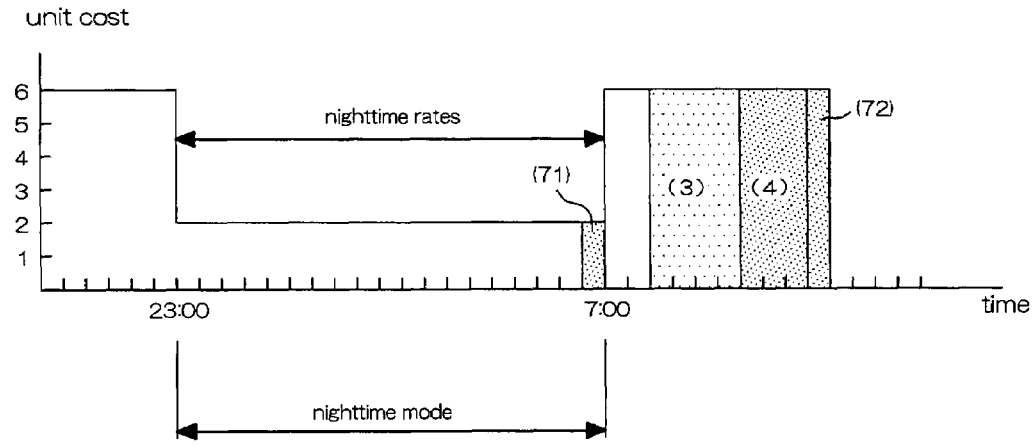
FIG. 5 is an explanatory diagram showing a calculation example of power costs when the print jobs are divided into image processing jobs and image forming jobs.

FIG. 5 shows power costs when the print jobs are divided into image processing jobs and image forming jobs. Here, image processing jobs refer to jobs in which the jobs are to be processed into a printable format, for example converting image information that is saved in a PDF format into a bitmap format. On the other hand, image forming jobs refer to jobs in which image forming is performed onto a recording medium by executing thermal transfer and fixing or the like of the data that has undergone image processing.

As in the example shown in FIG. 4, even in a case where costs can be kept lower by executing the print jobs after the canceling of nighttime mode, when the print jobs are divided into image processing jobs ((71) in FIG. 4) and image forming jobs ((72) in FIG. 4), since the image processing jobs ((71) in FIG. 5) do not require a warm up, it is possible to keep costs lower by executing the processing for only the image processing jobs (71) during nighttime rates. Accordingly, when it is planned such that the print job (7) shown in FIG. 4 is divided and only the image processing job (71) is processed during the period of nighttime rates, the costs incurred in the image processing job (71) are 2 (=1 unit of time×2 units of cost). After this, when the image forming job (72) that is saved is executed after nighttime mode is canceled and the warm up (3) is carried out and some print jobs (4) in FIG. 5 are executed, the costs incurred in printing the image forming job (72) at this time are 6 (=1 unit of time×6 units of cost), such that the total cost incurred for the image processing job (71) and the image forming job (72) is 8 (=2+6). That is, by dividing the print job (7) into the image processing job (71) and the image forming job (72) and dividing the execution timings of the jobs to the nighttime rates time period and the time period after nighttime mode is canceled, it is possible to keep costs even further lower than the total cost of 12 incurred in print processing as in the case shown in FIG. 4.

In the image forming apparatus 1 of the present embodiment, calculation processing of power costs are fundamentally carried out for the three patterns (FIG. 3 to FIG. 5) described above based on the print jobs of image information saved in the image information storage unit 15 during nighttime mode, and the pattern having the lowest total of power costs among these is selected and the print execution timings are set in accordance with that pattern.

<Description of Process of Setting Print Execution Timings>

Figure 6:
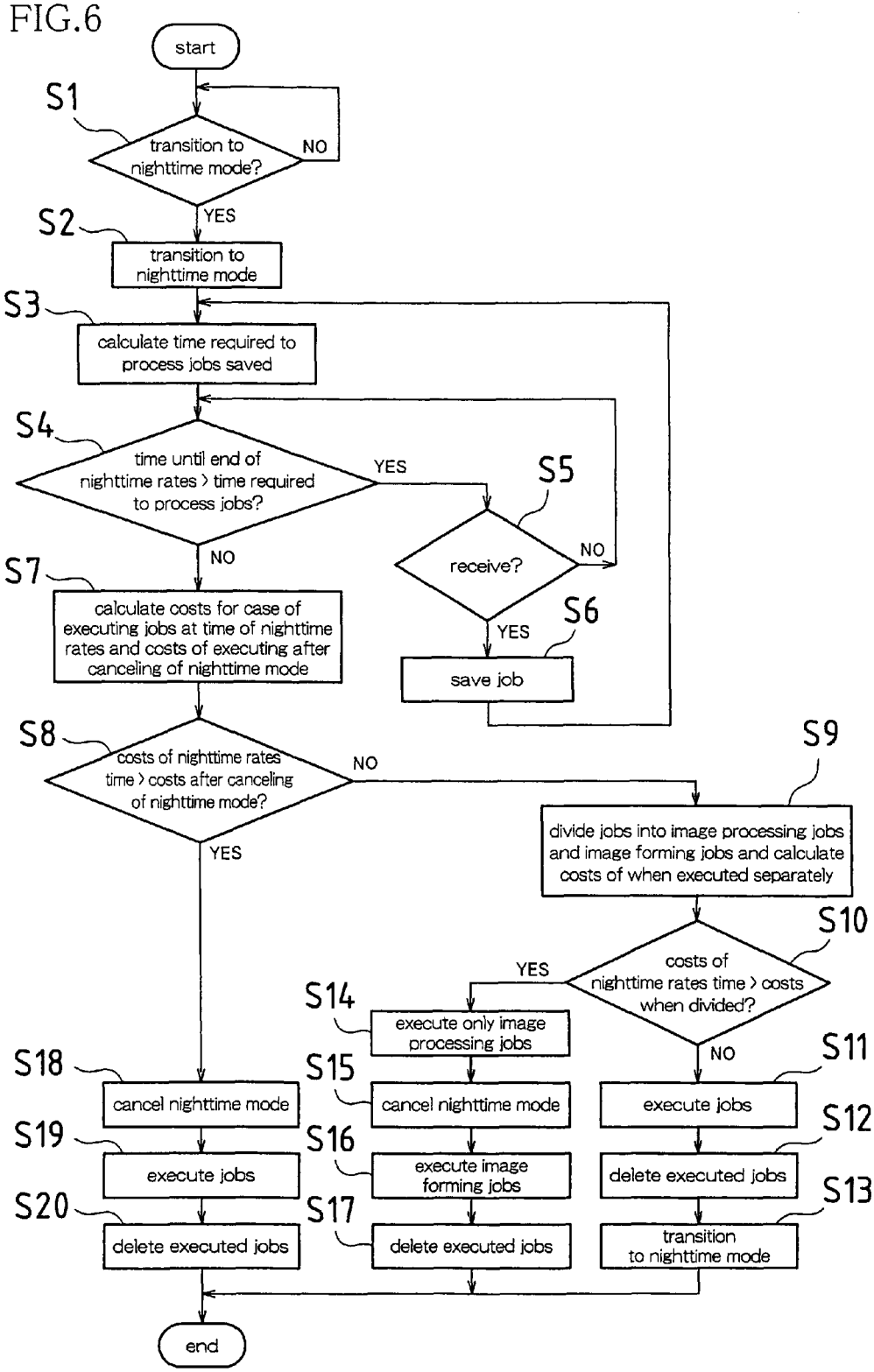
FIG. 6 is a flowchart for describing a process of setting execution timings for print jobs that have been stored (saved) in an image information storage unit during nighttime mode.

Next, based on the above-described examples of calculating power costs, description is given with reference to the flowchart shown in FIG. 6 concerning a process of setting execution timings for print jobs of image information saved in the image information storage unit 15 during nighttime mode.

When certain determined conditions are satisfied such as a time specification or no jobs in a fixed period (when determined "yes" at step S1), then the image forming apparatus 1 transitions (step S2) to nighttime mode (power saving mode).

Upon transitioning to nighttime mode, first the time required for processing the print jobs of image information saved in the image information storage unit 15 is calculated (step S3) by the image processing time management unit 20 and a confirmation is performed (step S4) as to whether or not the print jobs of the saved image information can be completed within the time of nighttime rates. As a result, when the print jobs can be completed within the time of nighttime rates (when determined "yes" at step S4), print processing does not commence but monitoring is performed (step S5) as to whether or not a new job has been received.

The image information control unit 18 repeats the confirmation process of step S4 and the monitoring process of step S5 in this manner and when a new job is received via the communications unit 11 (when determined "yes" at step S5), the received job is saved (step S6) in the image information storage unit 15 and the procedure returns to step S3, then the time required for processing the print jobs of image information saved in the image information storage unit 15 is calculated by the image processing time management unit 20, and a confirmation is performed (step S4) as to whether or not the print jobs of the saved image information can be completed within the time of nighttime rates. In this way, when new image information has been received during nighttime mode, as long as the time until the end of nighttime rates is not determined at step S4 to exceed the time required to process the print jobs of all the saved image information, then newly received image information continues to be successively saved in the image information storage unit 15.

On the other hand, when with the passing of time it becomes a time at which print processing of the saved image information can be completed at a timing by which the nighttime rates finish (when determined "no" at step S4), the image information control unit 18 commences processing of the print jobs. That is, at the time of commencement of processing, power costs are calculated (step S7) respectively for a case (the pattern shown in FIG. 3) in which the print jobs of all the image information saved in the image information storage unit 15 are processed (immediately processed) in the nighttime rates time period, and a case (the pattern shown in FIG. 4) in which processing is not carried out at that point and the print jobs are processed (executed) after the canceling of nighttime mode, that is, after the image forming apparatus 1 has been warmed up.

Then, these costs are compared (step S8), and in the case (the case of the pattern shown in FIG. 4) where the cost of immediate processing is lower, then next the jobs are divided into image processing jobs and image forming jobs, and the power costs are calculated (step S9) of a case (the pattern shown in FIG. 5) in which the image processing jobs are processed immediately and the image forming jobs are processed after the image forming apparatus 1 has been warmed up after the canceling of nighttime mode. Then, the costs in the case of immediate processing and the case of divided processing are compared (step S10), and when cost of immediate processing is lower (when determined "no" at step S10), then a warm up is executed immediately during nighttime mode and processing for printing commences (step S11). Then, after the processing is finished, the saved image information is deleted (step S12) and a transition is made (step S13) to nighttime mode again until nighttime mode is canceled.

On the other hand, when the cost of divided processing is lower (when determined "yes" at step S10), then only the image processing jobs of the print jobs of the saved image information are executed (step S14) during nighttime mode. Then, the image forming apparatus 1 waits (step S15) for nighttime mode to be canceled, after which the image forming jobs are executed (step S16) after the image forming apparatus 1 has been warmed up. Then, after the processing is finished, the saved image information is deleted (step S17).

Furthermore, when the result of the cost comparison at step S8 is that the cost of processing after the canceling of nighttime mode is lower (the case of the pattern shown in FIG. 5), then the image forming apparatus 1 waits (step S18) for nighttime mode to be canceled, after which the print jobs are executed (step S19) after the image forming apparatus 1 has been warmed up. Then, after the processing is finished, the saved image information is deleted (step S20).

It should be noted that in a case where new image information is received during the immediate processing of step S11, the print job of the received image information may be executed continuously after the completion of the print jobs currently being processed. Or the print job of the received image information may be set to be executed after nighttime mode is canceled and the daytime warm up is performed. Furthermore, any print job received during a period from after the immediate processing of step S11 until the canceling of nighttime mode may be set to be saved in the image information storage unit 15 and printed after the canceling of nighttime mode.

Furthermore, the above-described process for setting print execution timings is configured so that when new image information is received via the communications unit 11 during nighttime mode (when determined "yes" at step S5), after the received image information is saved (step S6) in the image information storage unit 15, the image processing time management unit 20 immediately calculates (step S3) the time required for print processing the saved image information, but it is not necessary that the calculation process is carried out each time new image information is received and may be carried out at fixed intervals. In this case, if it is immediately after the transition to nighttime mode, then the calculations may be carried out every hour for example, then as the time of the completion of nighttime mode approaches, the intervals may be progressively changed to be shorter, such as at fixed times of every 30 minutes, every 15 minutes, every ten minutes, and every five minutes for example. And in a case where no new image information is received during the fixed intervals, it is not necessary to carry out the calculation process of step S3 after the fixed interval has elapsed.

Furthermore, in a case where the image forming apparatus 1 of the above-described embodiment is an apparatus provided with a facsimile function, the image information control unit 18 may be set to perform the transition to nighttime mode after having continuously executed the print jobs of image information remaining in the image information storage unit 15 when the timing for transitioning to nighttime mode arrives during execution of the print jobs of image information saved in the image information storage unit 15. This reduces the number of times of warm ups and enables total power costs to be kept lower.

Furthermore, in a case where the image forming apparatus 1 of the present embodiment is a standalone printer apparatus, the image information control unit 18 may be set to shut off the power after having continuously executed the print jobs of image information remaining in the image information storage unit 15 when the timing for transitioning to nighttime mode arrives during execution of the print jobs of image information saved in the image information storage unit 15. By shutting off the power, power costs can be kept even lower compared to transitioning to nighttime mode.

The present invention can be embodied and practiced in other different forms without departing from the spirit and essential characteristics thereof Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus, comprising:

an image information storage unit that stores inputted image information as original image information, an image information processing unit that performs a process of converting the image information stored in the image information storage unit to outputable image information, an actual image forming unit that forms on a physical medium the outputable image information that has undergone the process of conversion by the image information processing unit, an image information control unit that controls transfer of image information between each of the units, a power supply control unit that controls a state of power supply of each of the units as required, a cost information management unit that holds basic cost information prescribing power costs dependent on a usage time and calculates unit cost information of an arbitrary time, and an image processing time management unit that calculates a processing time required for image output jobs in which image forming is to be performed by the image information processing unit and the actual image forming unit based on the image information stored in the image information storage unit, wherein, in relation to execution timings of image output jobs by the actual image forming unit, the image information control unit sets the execution timings of the image output jobs based on the basic cost information so that a total of image output costs of all target image output jobs stored in the image information storage unit is lowest, wherein, in relation to execution timings of image output jobs by the actual image forming unit, the image information control unit calculates a total of image output costs of an arbitrary time for the image output jobs of all the image information based on a processing time of the image output jobs of all target image information stored in the image information storage unit calculated by the image processing time management unit and unit cost information calculated by the cost information management unit, and sets a time at which the total of the image output costs is lowest as the execution timings of the image output jobs, and wherein the image information control unit resets at a fixed interval the execution timings of the image output jobs of all target image information stored in the image information storage unit when one or a plurality of sets of image information have been additionally stored in the image information storage unit before an execution timing of image output jobs that has been set arrives.

2. An image forming apparatus, comprising:

an image information storage unit that stores inputted image information as original image information, an image information processing unit that performs a process of converting the image information stored in the image information storage unit to outputable image information, an actual image forming unit that forms on a physical medium the outputable image information that has undergone the process of conversion by the image information processing unit, an image information control unit that controls transfer of image information between each of the units, a power supply control unit that controls a state of power supply of each of the units as required, a cost information management unit that holds basic cost information prescribing power costs dependent on a usage time and calculates unit cost information of an arbitrary time, and an image processing time management unit that calculates a processing time required for image output jobs in which image forming is to be performed by the image information processing unit and the actual image forming unit based on the image information stored in the image information storage unit, wherein, in relation to execution timings of image output jobs by the actual image forming unit, the image information control unit sets the execution timings of the image output jobs based on the basic cost information so that a total of image output costs of all target image output jobs stored in the image information storage unit is lowest, wherein, in relation to execution timings of image output jobs by the actual image forming unit, the image information control unit calculates a total of image output costs of an arbitrary time for the image output jobs of all the image information based on a processing time of the image output jobs of all target image information stored in the image information storage unit calculated by the image processing time management unit and unit cost information calculated by the cost information management unit, and sets a time at which the total of the image output costs is lowest as the execution timings of the image output jobs, and wherein the image information control unit resets the execution timings of the image output jobs of all target image information stored in the image information storage unit each time new image information is additionally stored in the image information storage unit before an execution timing of image output jobs that has been set arrives.

3. The image forming apparatus according to claim 1 or claim 2, wherein when new image information has been received during processing of image output jobs in a nighttime rates time period in nighttime mode, the image information control unit executes an image output job of the received image information subsequently after completion of the image output jobs currently being processed.

4. The image forming apparatus according to claim 1 or claim 2, wherein when new image information has been received during processing of image output jobs in a nighttime rates time period in nighttime mode, the image information control unit executes an image output job of the received image information after nighttime mode is canceled and a daytime warm up is performed.

5. The image forming apparatus according to claim 1 or 2, wherein when there is a large quantity of image output jobs of image information stored in the image information storage unit, the image information control unit divides the image output jobs into image processing jobs, in which image information stored in the image information storage unit undergoes a conversion process by the image information processing unit into outputable image information, and image forming jobs, in which the outputable image information is formed onto a physical medium by the actual image forming unit, then calculates costs required for the image processing jobs and the image forming jobs respectively and sets execution timings of the jobs respectively so that a total cost incurred in processing is lowest.

6. The image forming apparatus according to claim 1 or claim 2, wherein when there is a large quantity of image output jobs of a plurality of sets of image information stored in the image information storage unit during a nighttime mode period, the image output jobs are executed within a remaining time of the nighttime mode, and when there is a small quantity of the image output jobs, the image output jobs are executed in a daytime time period.

7. The image forming apparatus according to claim 1 or claim 2, wherein when the image forming apparatus is an apparatus having a facsimile reception function, the image information control unit transitions to nighttime mode after having continuously executed image output jobs of image information remaining in the image information storage unit when a timing for transitioning to the nighttime mode arrives during execution of the image output jobs of image information stored in the image information storage unit.

8. The image forming apparatus according to claim 1 or claim 2, wherein when the image forming apparatus is a printer apparatus, the image information control unit shuts off power after having continuously executed image output jobs of image information remaining in the image information storage unit when a timing for transitioning to nighttime mode arrives during execution of the image output jobs of image information stored in the image information storage unit.

* * * * *